US012385504B2

(12) United States Patent
Pan et al.

(10) Patent No.: US 12,385,504 B2
(45) Date of Patent: Aug. 12, 2025

(54) FLOATING COUNTER-ROTATING VORTEX-ELIMINATING DEVICE FOR PUMP STATION, AND PUMP STATION

(71) Applicant: Jiangsu University, Jiangsu (CN)

(72) Inventors: Qiang Pan, Jiangsu (CN); Desheng Zhang, Jiangsu (CN); Weidong Shi, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 18/700,711

(22) PCT Filed: Oct. 30, 2023

(86) PCT No.: PCT/CN2023/127804
§ 371 (c)(1),
(2) Date: Apr. 12, 2024

(87) PCT Pub. No.: WO2024/255071
PCT Pub. Date: Dec. 19, 2024

(65) Prior Publication Data

US 2025/0237237 A1 Jul. 24, 2025

(30) Foreign Application Priority Data

Jun. 12, 2023 (CN) ..... 202310689708.1

(51) Int. Cl.
*F04D 29/66* (2006.01)
*F04D 25/04* (2006.01)

(52) U.S. Cl.
CPC ..... *F04D 29/669* (2013.01); *F04D 25/04* (2013.01)

(58) Field of Classification Search
CPC ..... F04D 29/669; F04D 25/04; F03B 17/061; F03B 13/264; F03B 17/06; F03B 11/02;
(Continued)

(56) References Cited

U.S. PATENT DOCUMENTS 7,291,936 B1 * 11/2007 Robson ..... F03B 17/061 290/43
7,541,688 B2 * 6/2009 Mackie ..... F03B 17/061 290/54
(Continued)

FOREIGN PATENT DOCUMENTS

CN 205225878 5/2016
CN 106087904 * 11/2016 ..... E02B 8/06
(Continued)

OTHER PUBLICATIONS

"International Search Report (Form PCT/ISA/210) of PCT/CN2023/127804", mailed on Feb. 20, 2024, pp. 1-4.
(Continued)

*Primary Examiner* — Mark A Laurenzi
*Assistant Examiner* — Benjamin Doyle
(74) *Attorney, Agent, or Firm* — JCIPRNET

(57) ABSTRACT

A floating counter-rotating vortex-eliminating device for a pump station and the pump station; the floating counter-rotating vortex-eliminating device for the pump station includes a floating driving disc, a counter-rotating gear box, a reverse-rotating disc, a plane bearing, an elastic element, and a balance weight; the floating driving disc floats on a liquid surface near a water suction end of the pump station and is driven to rotate by power generated by a vortex; the floating driving disc is connected to the reverse-rotating disc through the counter-rotating gear box, such that the reverse-rotating disc and the floating driving disc have different rotating directions; the plane bearing is mounted at a bottom of the reverse-rotating disc, and the plane bearing is connected to the balance weight through the elastic element to prevent inclination.

9 Claims, 5 Drawing Sheets

(58) Field of Classification Search
CPC ..... F03B 11/06; F03B 13/10; F03B 13/22; F03B 13/26; F03B 17/063; F05B 2240/97; F05B 2220/706; F05B 2240/13; F05B 2240/133; F05B 2240/40; F05B 2240/911; F05B 2240/915; F05B 2240/9151; F05B 2240/93; F05B 2240/932; F05B 2240/95; F05B 2250/80; F05B 2280/6001
USPC ..... 417/336, 337; 290/54, 43, 53
See application file for complete search history.

(56) References Cited

U.S. PATENT DOCUMENTS

| | | | | |
|---|---|---|---|---|
| 10,458,386 | B2 * | 10/2019 | Watanabe | F03B 17/063 |
| 10,724,497 | B2 * | 7/2020 | Morris | F03B 11/02 |
| 2018/0106236 | A1 * | 4/2018 | Lee | F03B 13/264 |

FOREIGN PATENT DOCUMENTS

| | | |
|---|---|---|
| CN | 217539121 | 10/2022 |
| CN | 116575413 | 8/2023 |
| JP | S61153000 | 7/1986 |
| JP | 2015158135 | 9/2015 |
| KR | 101506945 | 3/2015 |

OTHER PUBLICATIONS

"Written Opinion of the International Searching Authority (Form PCT/ISA/237) of PCT/CN2023/127804", mailed on Feb. 20, 2024, pp. 1-4.

* cited by examiner

C-C

D-D

FLOATING COUNTER-ROTATING VORTEX-ELIMINATING DEVICE FOR PUMP STATION, AND PUMP STATION

CROSS-REFERENCE TO RELATED APPLICATION

This application is a 371 of international application of PCT application serial no. PCT/CN2023/127804, filed on Oct. 30, 2023, which claims the priority benefit of China application no. 202310689708.1, filed on Jun. 12, 2023. The entirety of each of the above-mentioned patent applications is hereby incorporated by reference herein and made a part of this specification.

TECHNICAL FIELD

The present disclosure relates to the field of fluid machinery technologies, and in particular, to a floating counter-rotating vortex-eliminating device for a pump station and the pump station.

TECHNICAL BACKGROUND

A pump station forebay or a pump station intake bay is a flow passage component for providing uniform inflow for a large water pump, is a hydraulic structure where the water pump or a water suction pipe directly sucks water, and is commonly configured for flood control and drought relief, water use for industry and agriculture, as well as cooling systems of large power plants or nuclear power plants in cooperation with a high-flow axial (mixed) flow pump. Various vortexes exist in flowing of different working conditions in the pump station intake bay, and can be divided into free surface vortexes and submerged vortexes according to inducing positions, the vortexes with unstable heights can influence a flow state of a suction inlet of the water pump, which causes uneven distribution of an impeller load to influence an operation efficiency, and even cause cavitation of the water pump to generate noise and vibration, and the water pump cannot normally operate in serious conditions. Research shows that a reasonable vortex-eliminating device can stabilize a flow state in the intake bay to provide uniform inflow for the large water pump, thus facilitating high-efficiency and stable operation of the water pump.

Currently, domestic patents about the vortex-eliminating device for the pump station forebay mainly focuses on designing of a vortex-eliminating hydraulic structure, the prior art discloses a floating vortex-eliminating device, a groove is formed in a wall surface of the intake bay, a buoy is mounted, vortex formation is prevented through contact between the buoy and a water surface, but the solution has high construction and maintenance costs, is inflexible in use, and has low practicability for a large pump station forebay. The prior art discloses a floating net vortex-eliminating method, a vortex-eliminating floating net is mounted on the water surface of the intake bay to eliminate the vortexes in a targeted manner, but on the one hand, the solution is influenced by a size of meshes of the floating net, a hydraulic loss is serious when the meshes are too small, and vortexes smaller than the meshes may be generated when the meshes are too large; on the other hand, when a water level in the intake bay changes, the floating net is required to be mounted again according to the water level, time and labor are consumed, and a maintenance cost also rises greatly.

SUMMARY OF THE INVENTION

In view of the deficiencies in the prior art, the present disclosure provides a floating counter-rotating vortex-eliminating device for a pump station and the pump station; when a vortex is generated on a water surface, the floating device moves to the vortex under a traction action of a water flow, a driving disc has a same rotating direction as the vortex and drives a reverse-rotating blade to rotate reversely, a reaction force is generated to counteract the vortex, the free liquid surface vortex is weakened or eliminated, and a more uniform inflow is provided for a large water pump.

The above technical objective of the present disclosure is attained with the following technical means.

A floating counter-rotating vortex-eliminating device for a pump station is provided, including a floating driving disc, a counter-rotating gear box, a reverse-rotating disc, a plane bearing, an elastic element, and a balance weight, where the floating driving disc floats on a liquid surface near a water suction end of the pump station and is driven to rotate by power generated by a vortex; the floating driving disc is connected to the reverse-rotating disc through the counter-rotating gear box, such that the reverse-rotating disc and the floating driving disc have different rotating directions; the plane bearing is mounted at a bottom of the reverse-rotating disc, and the plane bearing is connected to the balance weight through the elastic element to prevent inclination;

the floating driving disc includes a plurality of driving blades, a buoyancy disc, a driving disc hub, a driving shaft, and a driving bevel gear; the plurality of driving blades are uniformly distributed between the buoyancy disc and the driving disc hub, an upper end of the driving shaft is connected to the driving disc hub, a lower end of the driving shaft is connected to the driving bevel gear, and the power generated by the vortex is applied to the plurality of driving blades, such that the floating driving disc and the vortex have a same rotating direction.

Further, sections of the plurality of driving blades have a shape of a quarter of a ring, the plurality of driving blades are radially distributed and have a same thickness, inlets and outlets of the plurality of driving blades are chamfered for transition, and a number of the plurality of driving blades is 3-6.

Further, the buoyancy disc has an outer contour of a ring stretching body, an inner diameter of the buoyancy disc is $R_1$, an outer diameter of the buoyancy disc is $R_2$, a height of the buoyancy disc is H, a cavity is formed in the buoyancy disc, and a volume of the buoyancy disc meets the following condition:

$$k\rho\pi(R_2^2 - R_1^2)H \geq M$$

where ρ is density of water; M is total mass of the floating counter-rotating vortex-eliminating device for the pump station; and k is a buoyancy factor.

Further, the reverse-rotating disc includes a reverse-rotating blade, a reverse-rotating disc hub, a reverse-rotating shaft, and a reverse-rotating bevel gear; an inner edge of the reverse-rotating blade is connected to the reverse-rotating disc hub; an upper end of the reverse-rotating shaft is connected to the counter-rotating gear box, a lower end of the reverse-rotating shaft is connected to the reverse-rotating disc hub, and the reverse-rotating disc and the vortex have opposite rotating directions.

Further, a ratio of an outer diameter $r_1$ of the reverse-rotating blade to an outer diameter $R_1$ of the plurality of driving blades is 0.6-0.8; a cross section of the reverse-rotating blade is rectangular, a height of the reverse-rotating blade is h, a width of the reverse-rotating blade is w, and the following conditions are met: $h \geq H$ and $h \geq 2w$.

Further, two transmission bevel gears are coaxially mounted in the counter-rotating gear box in a horizontal direction, and the driving bevel gear and the reverse-rotating bevel gear are coaxially mounted in the counter-rotating gear box in a vertical direction; the two transmission bevel gears are meshed with the driving bevel gear; the two transmission bevel gears are meshed with the reverse-rotating bevel gear; and the driving bevel gear drives the reverse-rotating bevel gear to rotate reversely through the two transmission bevel gears.

Further, mass m of the balance weight meets the following condition: $m \geq 0.3M$, where M is the total mass of the floating counter-rotating vortex-eliminating device for the pump station.

Further, a traction rope is connected between the water suction end of the pump station and the balance weight; a connecting point of the traction rope and the water suction end of the pump station is located in a middle between the liquid surface and an inlet of the water suction end; and a length L of the traction rope meets the following condition: $(T-t) \geq L \geq 0.8(T-t)$;

where T−t is a vertical distance between the liquid surface and the inlet of the water suction end.

A pump station is provided, including at least 2 floating counter-rotating vortex-eliminating devices for the pump station as defined above, where a first floating counter-rotating vortex-eliminating device of the 2 floating counter-rotating vortex-eliminating devices for the pump station is located on one side of a liquid surface near a water suction end of the pump station; a second floating counter-rotating vortex-eliminating device of the 2 floating counter-rotating vortex-eliminating devices for the pump station is located on an other side of the liquid surface near the water suction end of the pump station; a driving direction of the driving blades of the first floating counter-rotating vortex-eliminating device for the pump station is different from a driving direction of the driving blades of the second floating counter-rotating vortex-eliminating device for the pump station; the first floating counter-rotating vortex-eliminating device for the pump station is configured to eliminate a vortex of the liquid surface in a clockwise direction; and the second floating counter-rotating vortex-eliminating device for the pump station is configured to eliminate a vortex of the liquid surface in an anticlockwise direction.

The present disclosure has the advantages as follows.

1. In the floating counter-rotating vortex-eliminating device for the pump station according to the present disclosure, buoyancy generated by the buoyancy disc is larger than the total mass of the vortex-eliminating device, so as to ensure that the vortex-eliminating device floats on the water surface; when the vortex is generated on the liquid surface, the vortex-eliminating device can move to the vortex in a suspending manner under an action of the liquid flow, so as to carry out targeted vortex elimination and suppression. The driving blade has a consistent rotating direction with the vortex under an action of the vortex, and the reverse-rotating blade generates a reverse-rotating speed by the counter-rotating gear box, such that reverse-rotating flow is generated locally on the reverse-rotating blade, and the vortex of the liquid surface is counteracted and inhibited from downwards developing.
2. In the floating counter-rotating vortex-eliminating device for the pump station according to the present disclosure, since the water surface of a large pump station has large fluctuation, a spring and the balance weight provide a function of stabilizing the floating device, and furthermore, weight of the balance weight generally exceeds 30% of whole weight of the floating device, and even if the floating device inclines or overturns, the balance weight can allow the floating device to recover a vertical posture by self-gravity.
3. For the floating counter-rotating vortex-eliminating device for the pump station according to the present disclosure, when no vortex or a weak vortex exists on the water surface of the pump station, the traction rope can prevent the floating device from floating away from a periphery of a water suction pipe. A maximum length and a minimum length of the traction rope are designed, the maximum length is configured for preventing the floating device from colliding with a pump blade after the floating device enters the water suction pipe under an extreme working condition, and the minimum length is configured for ensuring that the floating device can float on the water surface.
4. In the pump station according to the present disclosure, at least 2 floating counter-rotating vortex-eliminating devices for a power station are mounted, and the driving direction of the driving blade of the first floating counter-rotating vortex-eliminating device for the pump station is different from the driving direction of the driving blade of the second floating counter-rotating vortex-eliminating device for the pump station; the first floating counter-rotating vortex-eliminating device for the pump station is configured to eliminate the vortex of the liquid surface in the clockwise direction; the second floating counter-rotating vortex-eliminating device for the pump station is configured to eliminate the vortex of the liquid surface in the anticlockwise direction; the driving blade of the first floating counter-rotating vortex-eliminating device for the pump station is a type I blade, and the type I blade is mounted on a left side of the water suction end of the pump station (at this point, if a right-hand screw rule is adopted, the vortex of the liquid surface rotates clockwise); the driving blade of the second floating counter-rotating vortex-eliminating device for the pump station is a type II blade, and the type II blade is mounted on a right side of the water suction end of the pump station (at this point, if the right-hand screw rule is adopted, the vortex of the liquid surface rotates anticlockwise); the solution is intended to allow the vortex of the liquid surface to be moved along the driving blade and guided directly upwards to avoid that the vortex moves downwards to generate air entrainment. The sections of the reverse-rotating blades are rectangular and the blades are radially distributed, such that an effect of stirring and vortex generation can be achieved to the maximum extent, and the vortex of the liquid surface is counteracted.

DESCRIPTION OF THE DRAWINGS

In order to more clearly explain the technical solutions of the embodiments of the present disclosure or the prior art, the drawings to be used in the descriptions of the embodiments or the prior art are briefly introduced as follows. The following drawings illustrate some embodiments of the present disclosure, and apparently, a person skilled in the art can obtain other drawings from these drawings without any creative effort.

In the drawings.

Figure 1:
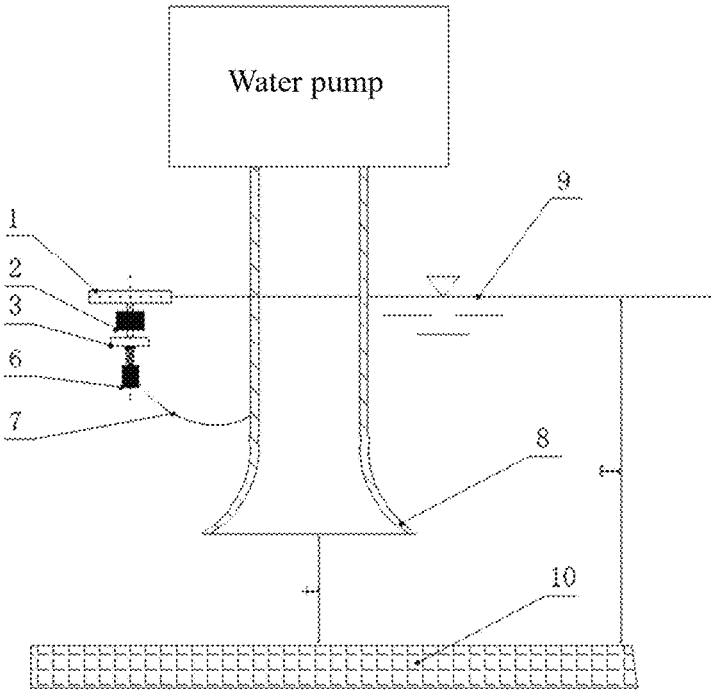
FIG. 1 is a schematic mounting diagram of a floating counter-rotating vortex-eliminating device for a power station according to the present disclosure.

1—floating driving disc; 11—driving blade; 12—buoyant disc; 13—driving disc hub; 14—driving shaft; 15—driving bevel gear; 2—counter-rotating gear box; 21—box cover; 22—transmission bevel gear; 23—rolling bearing; 3—reverse-rotating disc; 31—reverse-rotating blade; 32—reverse-rotating disc hub; 33—reverse-rotating shaft; 34—reverse-rotating bevel gear; 4—plane bearing; 5—spring; 6—balance weight; 7—traction rope; 8—water suction pipe; 9—liquid surface; 10—forebay bottom surface.

DETAILED DESCRIPTION OF THE EMBODIMENTS

Reference will be made in detail to embodiments of the present disclosure, and the examples of the embodiments are illustrated in the drawings, where the same or similar elements and the elements having same or similar functions are denoted by like reference numerals throughout the descriptions. The embodiments described below with reference to drawings are illustrative, and intended for explaining the present disclosure. The embodiments shall not be construed to limit the present disclosure.

In descriptions of the present disclosure, it should be understood that, directions or positional relationships indicated by terms "center", "longitudinal", "transverse", "length", "width", "thickness", "upper", "lower", "axial", "radial", "vertical", "horizontal", "inner", "outer", etc. are based on orientations or positional relationships shown in the accompanying drawings, and they are used only for describing the present disclosure and for description simplicity, but do not indicate or imply that an indicated device or element must have a specific orientation or be constructed and operated in a specific orientation. Therefore, it cannot be understood as a limitation on the present disclosure. In addition, the terms such as "first" and "second" are merely used for purposes of description and are not intended to indicate or imply relative importance or to imply the number of indicated technical features. Thus, the feature defined with "first" and "second" may include one or more of this feature explicitly or implicitly. In the description of the present disclosure, "a plurality of" means two or more unless otherwise specified.

In the present disclosure, unless specified or limited otherwise, the terms "mounted", "connected", "coupled", "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

Figure 2:
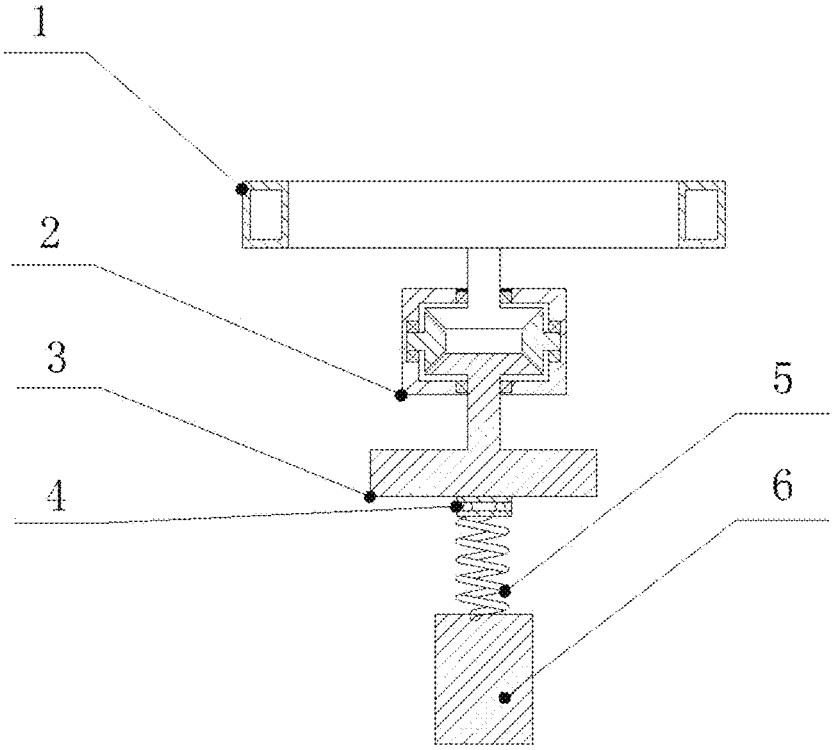
FIG. 2 is a structural view of the floating counter-rotating vortex-eliminating device for a power station according to the present disclosure.

As shown in FIGS. 1 and 2, a water suction pipe 8 is generally mounted at an inlet end of a water pump, i.e., a water suction end of a pump station; when the water pump operates, a liquid flow moves in a vertical direction along the water suction pipe, and when a flow rate is large or a water level of a water surface 9 is low, a vortex is usually generated on the water surface 9, and after the vortex enters the water suction pipe 8 along with the liquid flow, an efficiency and stability of the water pump are influenced. As strength of the vortex increases, the vortex may even entrain air into the flow, thus substantially reducing the efficiency and stability of the water pump. A floating counter-rotating vortex-eliminating device for a pump station according to the present disclosure includes a floating driving disc 1, a counter-rotating gear box 2, a reverse-rotating disc 3, a plane bearing 4, a spring 5, and a balance weight 6. The floating driving disc 1 floats on a liquid surface near the water suction end of the pump station, and the floating driving disc 1 is driven to rotate by power generated by the vortex; the floating driving disc 1 ensures that the whole device floats on the water surface and is kept in a same rotating direction as the vortex under an action of the vortex; the floating driving disc 1 is connected to the reverse-rotating disc 3 through the counter-rotating gear box 2, and the reverse-rotating disc 3 and the floating driving disc 1 rotate at a same speed in opposite directions through the counter-rotating gear box 2. The plane bearing 4 is mounted at a bottom of the reverse-rotating disc 3, and the plane bearing 4 is connected to the balance weight 6 through the spring 5 to prevent inclination. A lower end of the plane bearing 4 is connected to the spring 5, and when the reverse-rotating disc 3 rotates, the spring 5 is kept static. A lower end of the spring 5 is connected to the balance weight 6, and when the liquid surface 9 has fluctuation, the spring 5 and the balance weight 6 have a function of stabilizing the floating device, and furthermore, when the floating device inclines or overturns, the balance weight 6 allows the floating device to recover a vertical posture by self-gravity.

Figure 3:
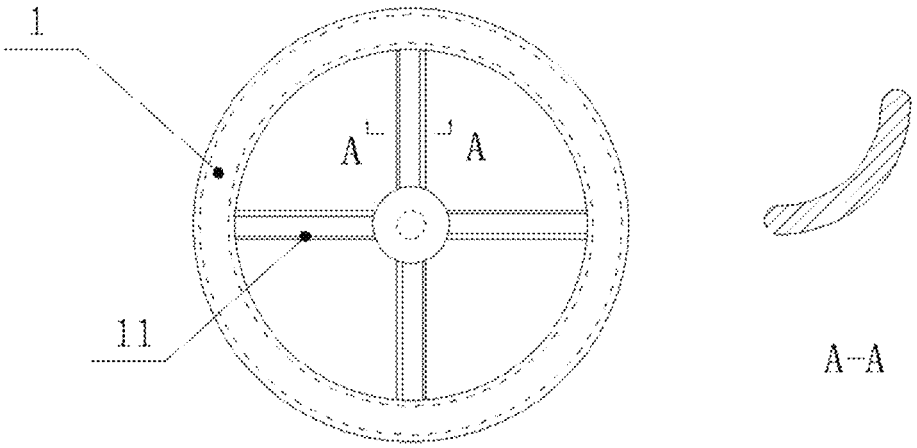
FIG. 3 is a schematic diagram of a type I driving blade of a floating driving disc in the present disclosure.
Figure 4:
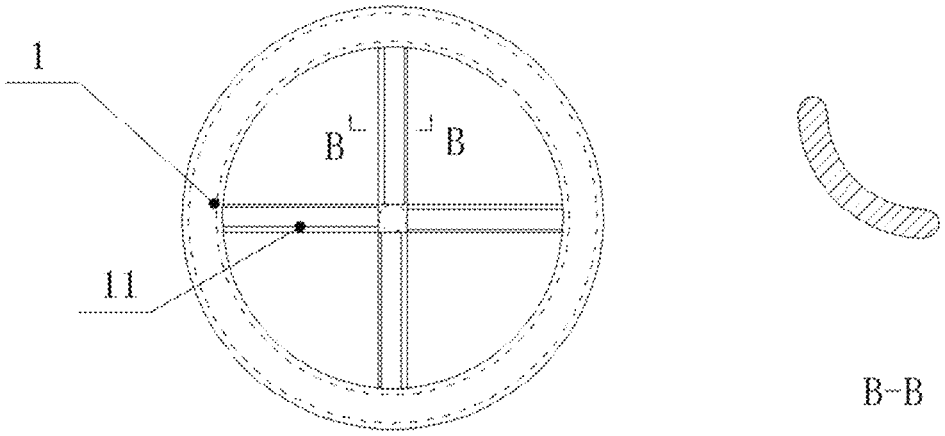
FIG. 4 is a schematic diagram of a type II driving blade of the floating driving disc in the present disclosure.
Figure 5:
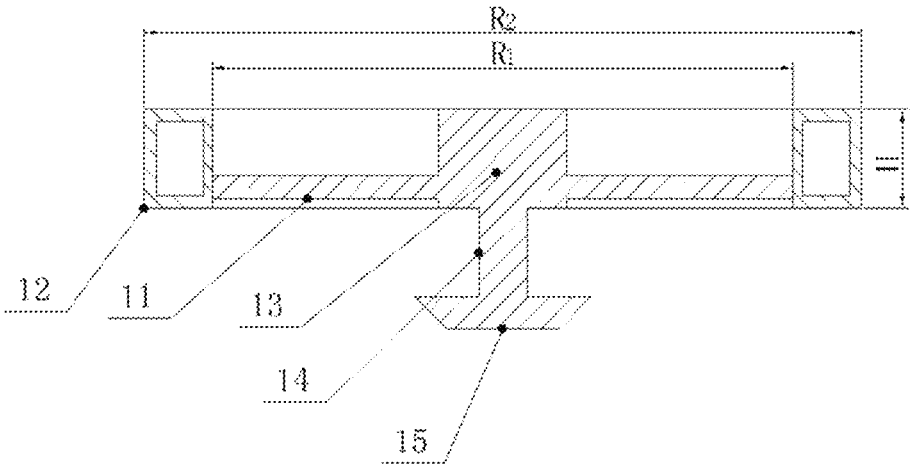
FIG. 5 is a sectional view of the floating driving disc in the present disclosure.

As shown in FIG. 5, the floating driving disc 1 includes driving blades 11, a buoyancy disc 12, a driving disc hub 13, a driving shaft 14, and a driving bevel gear 15; the plurality of driving blades 11 are uniformly distributed between the buoyancy disc 12 and the driving disc hub 13, an upper end of the driving shaft 14 is connected to the driving disc hub 13, a lower end of the driving shaft 14 is connected to the driving bevel gear 15, and the power generated by the vortex is applied to the driving blades 11, such that the floating driving disc 1 and the vortex have a same rotating direction. Sections of the driving blades 11 have a shape of a quarter of a ring, the driving blades 11 are radially distributed and have a same thickness, inlets and outlets of the driving blades 11 are chamfered for transition, and 3-6 driving blades 11 are provided. As shown in FIG. 3, the section A-A of the driving blade 11 has a type I shape, and the section of the type I driving blade has a shape of a quarter of a ring located in a fourth quadrant; as shown in FIG. 4, the section B-B of the driving blade 11 has a type II shape, and the section of the type II driving blade has a shape of a quarter of a ring located in a third quadrant. When a visual angle is along a direction of liquid flow, according to a right-hand screw rule, the vortex generated on a left side of the water suction pipe 8 has a vertically downward axis, and the type I driving blade is mounted; when the vortex generated on a right side of the water suction pipe 8 has a vertically upward axis, the type II driving blade is mounted, such that the rotating liquid flow can be guaranteed to move along the driving blade 11 and be guided directly upwards to avoid that the vortex moves downwards to generate air entrainment.

The buoyancy disc 12 has an outer contour of a ring stretching body, an inner diameter of the buoyancy disc 12 is $R_1$, an outer diameter of the buoyancy disc 12 is $R_2$, a height of the buoyancy disc 12 is H, a cavity is formed in the buoyancy disc, and a volume of the buoyancy disc 12 meets the following condition:

$$k\rho\pi(R_2^2 - R_1^2)H \geq M$$

where ρ is density of water; M is total mass of the floating counter-rotating vortex-eliminating device for the pump station; k is a buoyancy factor and is usually 0.5-0.8.

In the embodiment, the buoyancy disc 12 has a tubular outer contour, an inner diameter is $R_1$, an outer diameter is $R_2$, a height is H, a cavity is formed in the buoyancy disc, buoyancy generated by the buoyancy disc 12 is at least larger than total mass of the vortex-eliminating device, and if k is 0.5, maximum buoyancy generated when the buoyancy disc is completely immersed in water is 2M.

Figure 6:
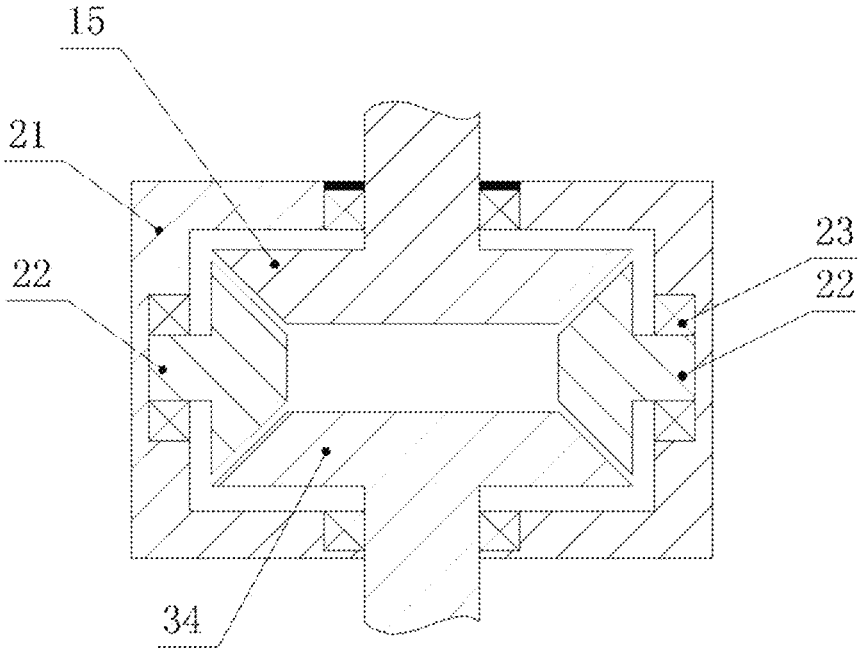
FIG. 6 is a schematic diagram of a counter-rotating gear box in the present disclosure.

As shown in FIG. 6, two transmission bevel gears 22 are coaxially mounted in the counter-rotating gear box 2 in a horizontal direction, and the driving bevel gear 15 and the reverse-rotating bevel gear 34 are coaxially mounted in the counter-rotating gear box 2 in a vertical direction; the two transmission bevel gears 22 are meshed with the driving bevel gear 15; the two transmission bevel gears 22 are meshed with the reverse-rotating bevel gear 34; the driving bevel gear 15 drives the reverse-rotating bevel gear 34 to rotate reversely through the two transmission bevel gears 22.

Figure 7:
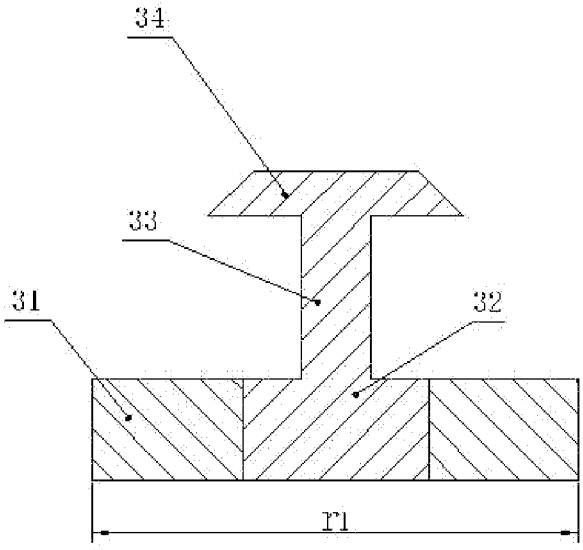
FIG. 7 is a schematic diagram of a reverse-rotating disc in the present disclosure.
Figure 7:
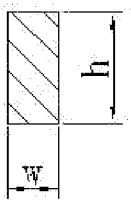
Figure 7:
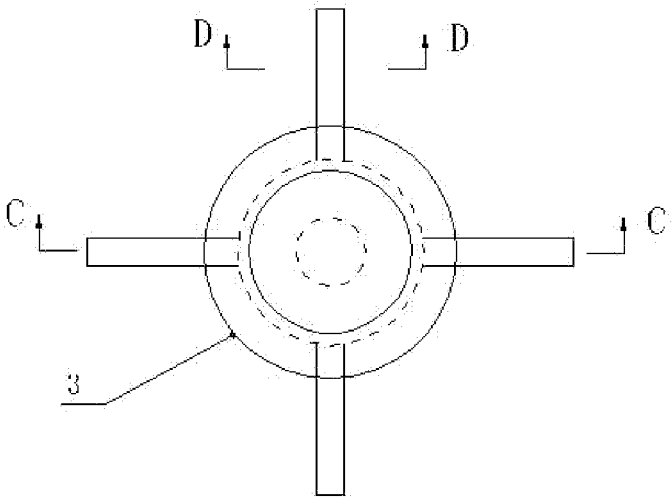

As shown in FIG. 7, the reverse-rotating disc 3 includes a reverse-rotating blade 31, a reverse-rotating disc hub 32, a reverse-rotating shaft 33, and a reverse-rotating bevel gear 34; an inner edge of the reverse-rotating blade 31 is connected to the reverse-rotating disc hub 32; an upper end of the reverse-rotating shaft 33 is connected to the counter-rotating gear box 2, a lower end of the reverse-rotating shaft 33 is connected to the reverse-rotating disc hub 32, and the reverse-rotating disc 3 and the vortex have opposite rotating directions; that is, the reverse-rotating disc 3 and the floating driving disc 1 have opposite rotating directions. Since the vortex has a conical contour, a ratio of an outer diameter $r_1$ of the reverse-rotating blade 31 to an outer diameter $R_1$ of the driving blade 11 is generally 0.6-0.8; in order to achieve a purpose of stirring and vortex generation to the maximum extent, the reverse-rotating blades 31 are radially distributed and have rectangular cross sections, a height of the reverse-rotating blades 31 is h, a width of the reverse-rotating blades 31 is w, and the following conditions are met: h≥H and h≥2w.

As shown in FIG. 1, the lower end of the spring 5 is connected to the balance weight 6, and the balance weight 6 has certain weight m which can be determined according to a fluctuation degree of the liquid surface under an actual operating condition, but should be set to at least 30% of whole weight M of the vortex-eliminating device; that is, m=0.3M. When a fluctuation amplitude of the liquid surface is large, the weight m of the balance weight 6 may be set to 50% of the whole weight M of the vortex-eliminating device; that is, m=0.5M.

As shown in FIG. 1, a traction rope 7 is connected between the water suction end of the pump station and the balance weight 6; the traction rope 7 has one end connected to the balance weight 6 and the other end connected to the water suction pipe 8, and a connecting point of the traction rope and the water suction pipe 8 is located in a middle between the liquid surface 9 and a lower edge of the water suction pipe 8. In order to ensure that the floating device can freely float to the vortex of the liquid surface, the traction rope 7 should have a certain length L, but it should be avoided that since the traction rope 7 is over long, the floating device is sucked into the water suction pipe under an extreme working condition and collides with a pump blade to damage a pump device, and therefore, the length L of the traction rope 7 is limited to generally meet the following condition: (T−t)≥L≥0.8(T−t);

where T−t is a vertical distance between the liquid surface 9 and an inlet of the water suction end. T is a vertical height from the liquid surface 9 to a forebay bottom surface 10, and t is a vertical height from the lower edge of the water suction pipe 8 to the forebay bottom surface 10.

Figure 8:
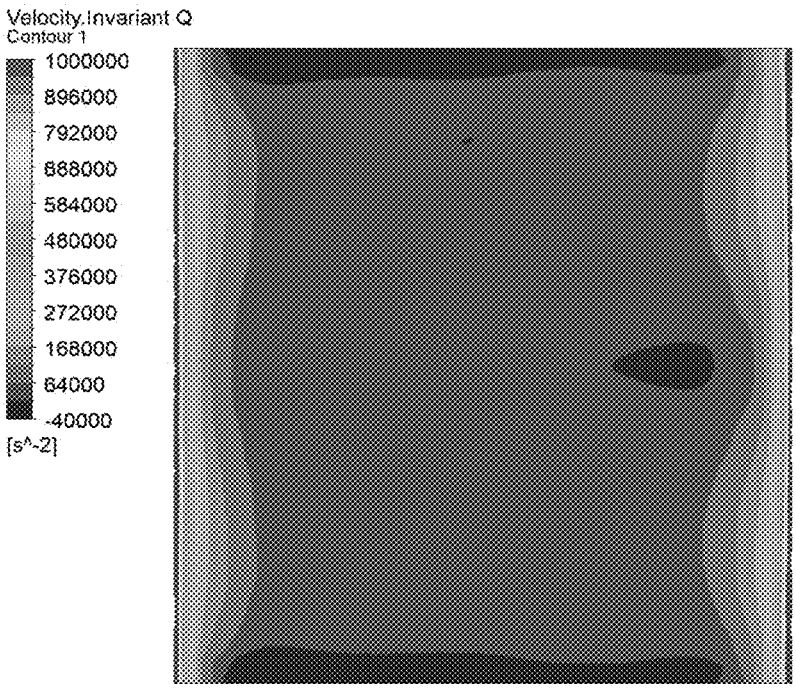
FIG. 8 is a simulation view of a liquid surface without the floating counter-rotating vortex-eliminating device for the pump station.
Figure 9:
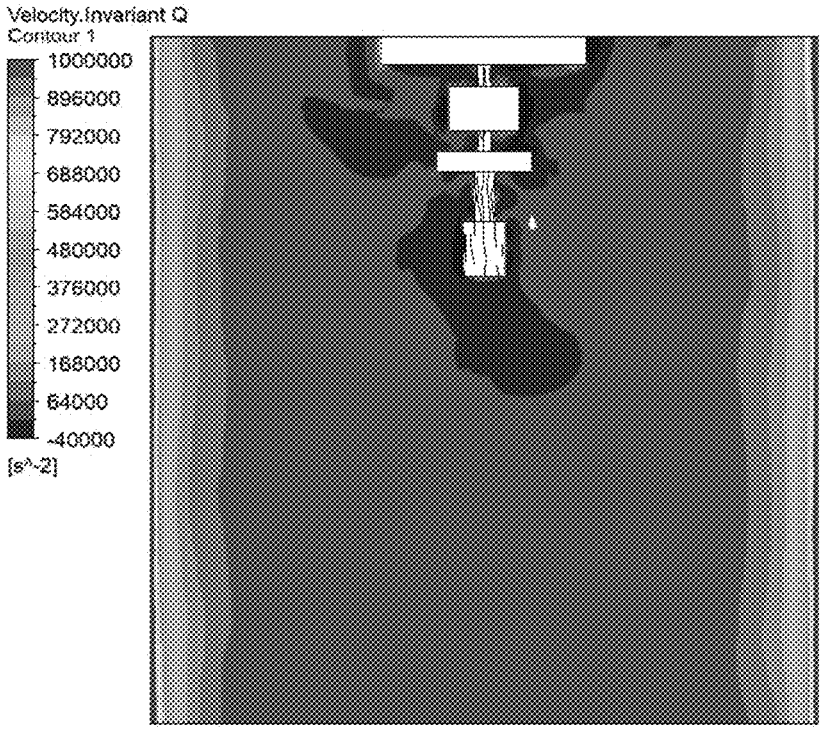
FIG. 9 is a simulation view of the liquid surface with the floating counter-rotating vortex-eliminating device for the pump station.

As shown in FIGS. 8 and 9, an effect of the floating counter-rotating vortex-eliminating device for the pump station according to the present disclosure is observed with numerical simulation, and rotary flow is artificially generated in a cylindrical flow field in a wall surface rotation manner. The above drawings are schematic sectional diagrams of the cylindrical flow field, two sides represent a rotating wall surface, and variables adopted in the cloud diagram are based on Q criteria and are dimensionless parameters for representing the strength of the vortex. Since the artificial vortex is generated by rotating the cylindrical surface, it can be seen that a maximum value (red region) of the vortex occurs on two sides of the wall surface and gradually decreases towards the middle, and after the vortex-eliminating device is provided, the strength of the vortex locally located at the vortex-eliminating device is lower, and the vortex-eliminating device has a dissipation effect on transfer of the vortex.

A pump station includes at least 2 floating counter-rotating vortex-eliminating devices for a pump station, where the first floating counter-rotating vortex-eliminating device for the pump station is located on one side of a liquid surface near a water suction end of the pump station; the second floating counter-rotating vortex-eliminating device for the pump station is located on the other side of the liquid surface near the water suction end of the pump station; a driving direction of the driving blade 11 of the first floating counter-rotating vortex-eliminating device for the pump station is different from a driving direction of the driving blade 11 of the second floating counter-rotating vortex-eliminating device for the pump station; the first floating counter-rotating vortex-eliminating device for the pump station is configured to eliminate a vortex of the liquid surface in a clockwise direction; and the second floating counter-rotating vortex-eliminating device for the pump station is configured to eliminate a vortex of the liquid surface in an anticlockwise direction.

It should be understood that although the specification is described in terms of various embodiments, not every embodiment only includes an independent technical solution, and such description of the specification is for clarity only; those skilled in the art should take the specification as a whole, and the technical solutions in various embodiments may also be appropriately combined to form other embodiments that may be understood by those skilled in the art.

The series of detailed descriptions listed above are only specific descriptions for the feasible embodiments of the present disclosure, and are not intended to limit the protection scope of the present disclosure, and all equivalent embodiments or modifications made without departing from the technical spirit of the present disclosure shall be included within the protection scope of the present disclosure.

The invention claimed is:

1. A floating counter-rotating vortex-eliminating device for a pump station, comprising:

a floating driving disc, a counter-rotating gear box, a reverse-rotating disc, a plane bearing, an elastic element, and a balance weight; the floating driving disc floats on a liquid water surface near a water suction end of the pump station and is driven to rotate by power generated by a vortex of the water surface; the floating driving disc is connected to the reverse-rotating disc through the counter-rotating gear box, such that the reverse-rotating disc and the floating driving disc have different rotating directions; the plane bearing is mounted at a bottom of the reverse-rotating disc, the plane bearing is connected to the balance weight through the elastic element to prevent inclination;

the floating driving disc comprises a plurality of driving blades, a buoyancy disc, a driving disc hub, a driving shaft, and a driving bevel gear; the plurality of driving blades are uniformly distributed between the buoyancy disc and the driving disc hub, an upper end of the driving shaft is connected to the driving disc hub, a lower end of the driving shaft is connected to the driving bevel gear, the power generated by the vortex is applied to the plurality of driving blades, such that the floating driving disc and the vortex have a same rotating direction.

2. The floating counter-rotating vortex-eliminating device for the pump station according to claim 1, wherein sections of the plurality of driving blades have a shape of a quarter of a ring, the plurality of driving blades are radially distributed and have a same thickness, inlets and outlets of the plurality of driving blades are chamfered for transition, and a number of the plurality of driving blades is 3-6.

3. The floating counter-rotating vortex-eliminating device for the pump station according to claim 1, wherein the buoyancy disc has an outer contour of a ring stretching body, an inner diameter of the buoyancy disc is $R_1$, an outer diameter of the buoyancy disc is $R_2$, a height of the buoyancy disc is H, a cavity is formed in the buoyancy disc, a volume of the buoyancy disc meets the following condition:

$$k\rho\pi(R_2^2-R_1^2)H\geq M$$

wherein, ρ is density of water; M is total mass of the floating counter-rotating vortex-eliminating device for the pump station; and k is a buoyancy factor.

4. The floating counter-rotating vortex-eliminating device for the pump station according to claim 1, wherein the reverse-rotating disc comprises a reverse-rotating blade, a reverse-rotating disc hub, a reverse-rotating shaft, and a reverse-rotating bevel gear; an inner edge of the reverse-rotating blade is connected to the reverse-rotating disc hub; an upper end of the reverse-rotating shaft is connected to the counter-rotating gear box, a lower end of the reverse-rotating shaft is connected to the reverse-rotating disc hub, the reverse-rotating disc and the vortex have opposite rotating directions.

5. The floating counter-rotating vortex-eliminating device for the pump station according to claim 4, wherein a ratio of an outer diameter of the reverse-rotating blade to an outer diameter of the plurality of driving blades is 0.6-0.8; a cross section of the reverse-rotating blade is rectangular, a height of the reverse-rotating blade is h, a width of the reverse-rotating blade is w, the following conditions are met: h≥H and h≥2w.

6. The floating counter-rotating vortex-eliminating device for the pump station according to claim 4, wherein two transmission bevel gears are coaxially mounted in the counter-rotating gear box in a horizontal direction, the driving bevel gear and the reverse-rotating bevel gear are coaxially mounted in the counter-rotating gear box in a vertical direction; the two transmission bevel gears are meshed with the driving bevel gear; the two transmission bevel gears are meshed with the reverse-rotating bevel gear; the driving bevel gear drives the reverse-rotating bevel gear to rotate reversely through the two transmission bevel gears.

7. The floating counter-rotating vortex-eliminating device for the pump station according to claim 1, wherein mass m of the balance weight meets the following condition: m>0.3M, M is total mass of the floating counter-rotating vortex-eliminating device for the pump station.

8. The floating counter-rotating vortex-eliminating device for the pump station according to claim 1, wherein a traction rope is connected between the water suction end of the pump station and the balance weight; a connecting point of the traction rope and the water suction end of the pump station is located in a middle between the liquid water surface and an inlet of the water suction end; a length L of the traction rope meets the following condition: (T−t)≥L≥0.8 (T−t);

wherein, T−t is a vertical distance between the liquid water surface and the inlet of the water suction end.

9. A pump station, comprising:

at least two floating counter-rotating vortex-eliminating devices for the pump station according to claim 1, a first floating counter-rotating vortex-eliminating device of the at least two floating counter-rotating vortex-eliminating devices for the pump station is located on one side of the liquid water surface near the water suction end of the pump station; a second floating counter-rotating vortex-eliminating device of the at least two floating counter-rotating vortex-eliminating devices for the pump station is located on an other side of the liquid water surface near the water suction end of the pump station; a driving direction of the driving blades of the first floating counter-rotating vortex-eliminating device for the pump station is different from a driving direction of the driving blades of the second floating counter-rotating vortex-eliminating device for the pump station; the first floating counter-rotating vortex-eliminating device for the pump station is configured to eliminate a vortex of the liquid water surface in a clockwise direction; the second floating counter-rotating vortex-eliminating device for the pump station is configured to eliminate a vortex of the liquid water surface in an anticlockwise direction.

* * * * *